US011406166B1

(12) United States Patent
Robinson-Okai

(10) Patent No.: US 11,406,166 B1
(45) Date of Patent: Aug. 9, 2022

(54) ILLUMINABLE HAIR ATTACHMENT ASSEMBLY

(71) Applicant: Jasu Robinson-Okai, Brooklyn Heights, NY (US)

(72) Inventor: Jasu Robinson-Okai, Brooklyn Heights, NY (US)

( * ) Notice: Subject to any disclaimer, the term of this patent is extended or adjusted under 35 U.S.C. 154(b) by 0 days.

(21) Appl. No.: 17/243,671

(22) Filed: Apr. 29, 2021

(51) Int. Cl.

| | |
|---|---|
| ***A44C 15/00*** | (2006.01) |
| ***A45D 8/00*** | (2006.01) |
| *F21V 23/04* | (2006.01) |
| *F21V 21/005* | (2006.01) |

(52) U.S. Cl.
CPC ..... *A44C 15/0015* (2013.01); *A45D 8/004* (2021.01); *F21V 21/005* (2013.01); *F21V 23/0435* (2013.01)

(58) Field of Classification Search
CPC ... A44C 15/0015; A45D 8/004; F21V 21/005; F21V 23/0435; F21V 33/0004; A41D 27/085
See application file for complete search history.

(56) References Cited

U.S. PATENT DOCUMENTS

| | | | | |
|---|---|---|---|---|
| 3,501,628 | A | 3/1970 | Madden | |
| 5,727,577 | A | 3/1998 | Post | |
| D443,724 | S | 6/2001 | Neary | |
| 6,578,981 | B2 | 6/2003 | Jackson | |
| 7,131,743 | B2 * | 11/2006 | Leason | A44C 15/0015 63/3 |
| 7,731,378 | B2 | 6/2010 | Dutcher | |
| 9,200,797 | B1 * | 12/2015 | McNulty | F21V 33/0004 |
| 2004/0007243 | A1 | 1/2004 | Paterson | |
| 2004/0031287 | A1 * | 2/2004 | Leason | A45D 8/00 63/1.13 |
| 2015/0213708 | A1 * | 7/2015 | Barzangi | H04W 4/90 455/404.2 |

FOREIGN PATENT DOCUMENTS

| | | | |
|---|---|---|---|
| CN | 204444642 U | * | 7/2015 |
| CN | 208048265 U | * | 11/2018 |

OTHER PUBLICATIONS

Machine translation of Li's (reference N) abstract (Year: 2018).*
Machine translation of Dong's (reference O) abstract (Year: 2015).*

* cited by examiner

*Primary Examiner* — Leah Simone Macchiarolo

(57) ABSTRACT

An illuminable hair attachment assembly for providing remotely controlled illumination includes a hair attachment, which in turn comprises a shell. At least one face of the shell is substantially transparent. A bulb is engaged to the shell and is positioned in the shell. A fastener engaged to the shell can engage a lock of hair. The hair attachment is one of a plurality of hair attachments, at least one of which has a microprocessor, a battery, and a first transceiver engaged to and positioned in the shell. The microprocessor is operationally engaged to the battery and the first transceiver. The shells are selectively mutually couplable so that all the bulbs of mutually coupled hair attachments are operationally engaged to the microprocessor. Programming code positioned on an electronic device of a user and enables the electronic device to signal the microprocessor to selectively actuate the bulbs.

15 Claims, 5 Drawing Sheets

ILLUMINABLE HAIR ATTACHMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hair attachments and more particularly pertains to a new hair attachment for providing remotely controlled illumination. The present invention discloses hair attachments, each comprising a bulb, which are mutually couplable and engageable to a lock of hair via fasteners. Programming code is selectively positionable on an electronic device of a user and enables the electronic device to signal a microprocessor, via a first transceiver, to selectively actuate the bulbs.

(2) Description of Related Art Including Information Disclosed Under 37 CFR 1.97 and 1.98

The prior art relates to hair attachments, and in particular hair attachments comprising bulbs. Prior art hair attachments may comprise various devices comprising bulbs, or other light emitters, which can be engaged to hair. What is lacking in the prior art are hair attachments, each comprising a bulb, which are mutually couplable and engageable to a lock of hair via fasteners, wherein the bulbs can be remotely actuated using programming code positioned on an electronic device of a user.

BRIEF SUMMARY OF THE INVENTION

An embodiment of the disclosure meets the needs presented above by generally comprising a hair attachment, which in turn comprises a shell, which defines an interior space. At least one face of the shell is substantially transparent. A bulb is engaged to the shell and is positioned in the interior space. A fastener is engaged to the shell and is configured to engage a lock of hair to removably engage the shell to the lock of hair. The hair attachment is one of a plurality of hair attachments. At least one of the hair attachments has a microprocessor, a battery, and a first transceiver engaged to the shell and positioned in the interior space. The microprocessor is operationally engaged to the battery and the first transceiver. The shells are selectively mutually couplable so that all the bulbs of mutually coupled hair attachments are operationally engaged to the microprocessor. Programming code is selectively positionable on an electronic device of a user and enables the electronic device to signal the microprocessor, via the first transceiver, to selectively actuate the bulbs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
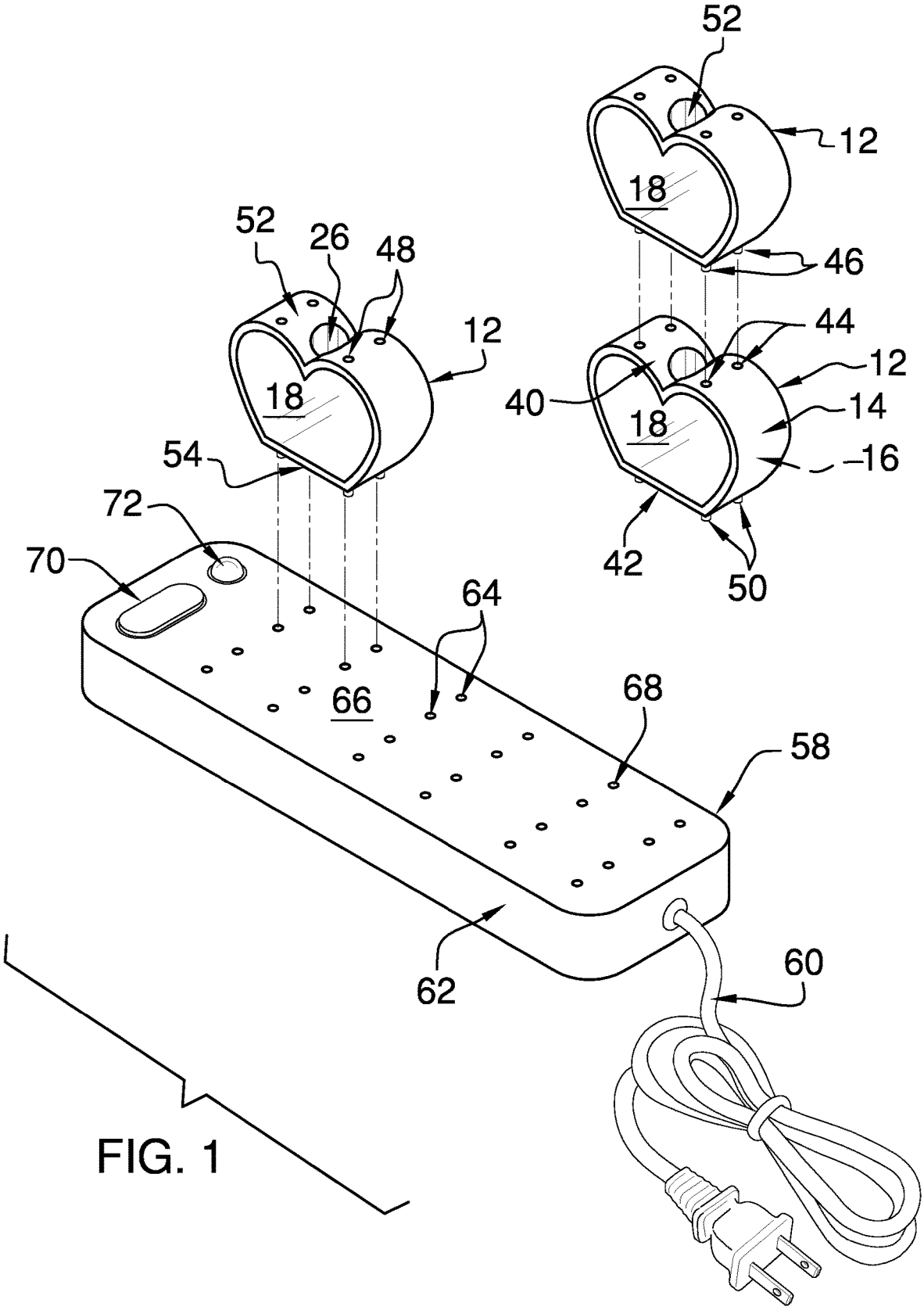
FIG. 1 is an isometric perspective view of an illuminable hair attachment assembly according to an embodiment of the disclosure.

With reference now to the drawings, and in particular to FIGS. 1 through 6 thereof, a new hair attachment embodying the principles and concepts of an embodiment of the disclosure and generally designated by the reference numeral 10 will be described.

As best illustrated in FIGS. 1 through 6, the illuminable hair attachment assembly 10 generally comprises a hair attachment 12, which in turn comprises a shell 14, which defines an interior space 16. At least one face 18 of the shell 14 is substantially transparent. A bulb 20 is engaged to the shell 14 and is positioned in the interior space 16. The bulb 20 comprises a plurality of light emitting diodes 22.

A fastener 24 is engaged to the shell 14 and is configured to engage a lock of hair to removably engage the shell 14 to the lock of hair. A lock of hair should be understood to include a strand or a braid of hair. The fastener 24 may comprise a tube 26 passing through the shell 14 and isolated from the interior space 16. The tube 26 is configured for insertion of a lock of hair to removably engage the shell 14 to the lock of hair. The present invention anticipates the fastener 24 comprising other fastening means, such as, but not limited to, clips, elastic bands, and the like.

The hair attachment 12 is one of a plurality of hair attachments 12. At least one of the hair attachments 12 has a microprocessor 28, a battery 30, and a first transceiver 32 engaged to the shell 14 and positioned in the interior space 16. The microprocessor 28 is operationally engaged to the battery 30 and the first transceiver 32. The shells 14 are selectively mutually couplable so that all the bulbs 20 of mutually coupled hair attachments 12 are operationally engaged to the microprocessor 28.

Figure 4:
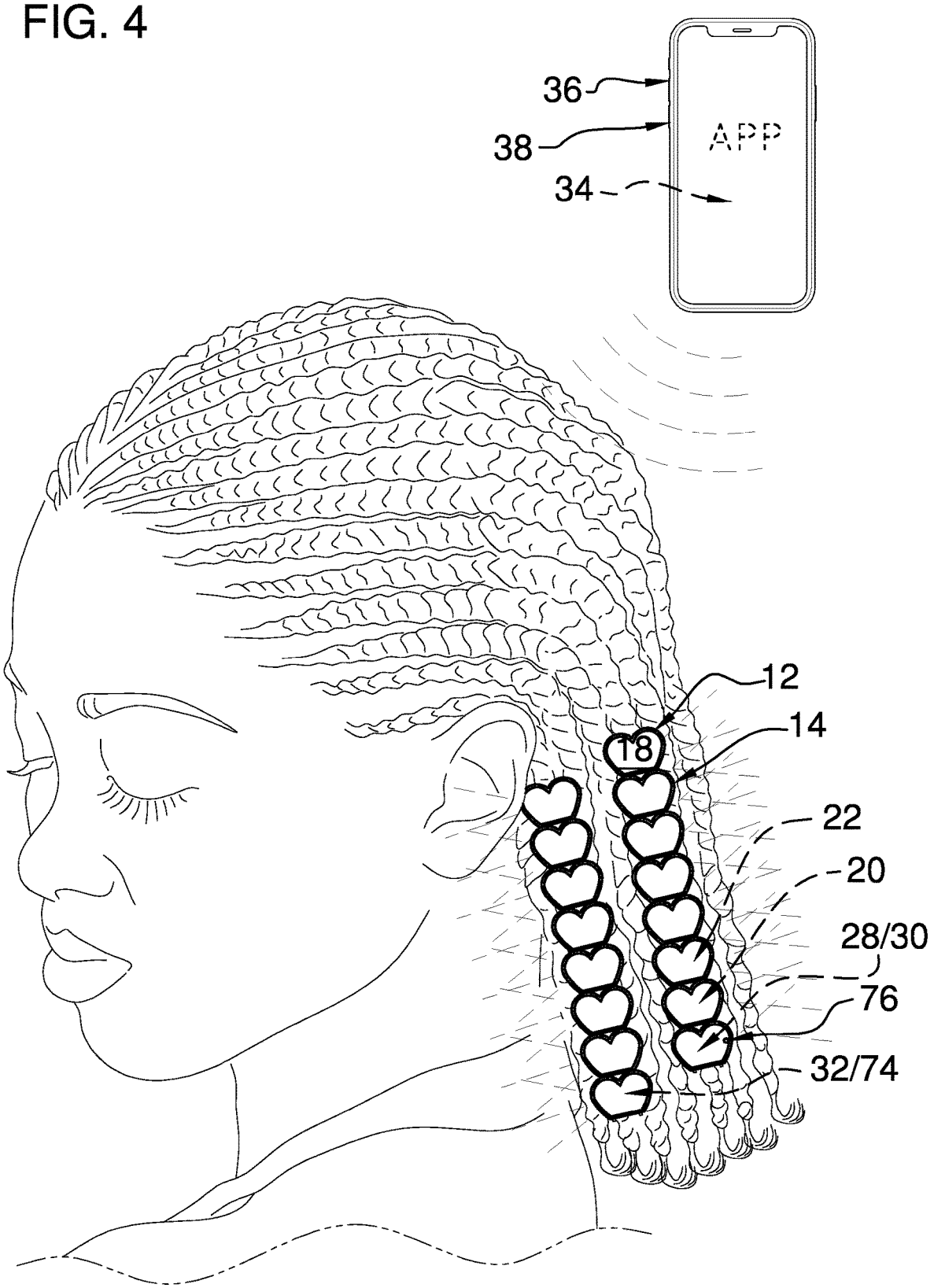
FIG. 4 is an in-use view of an embodiment of the disclosure.
Figure 5:
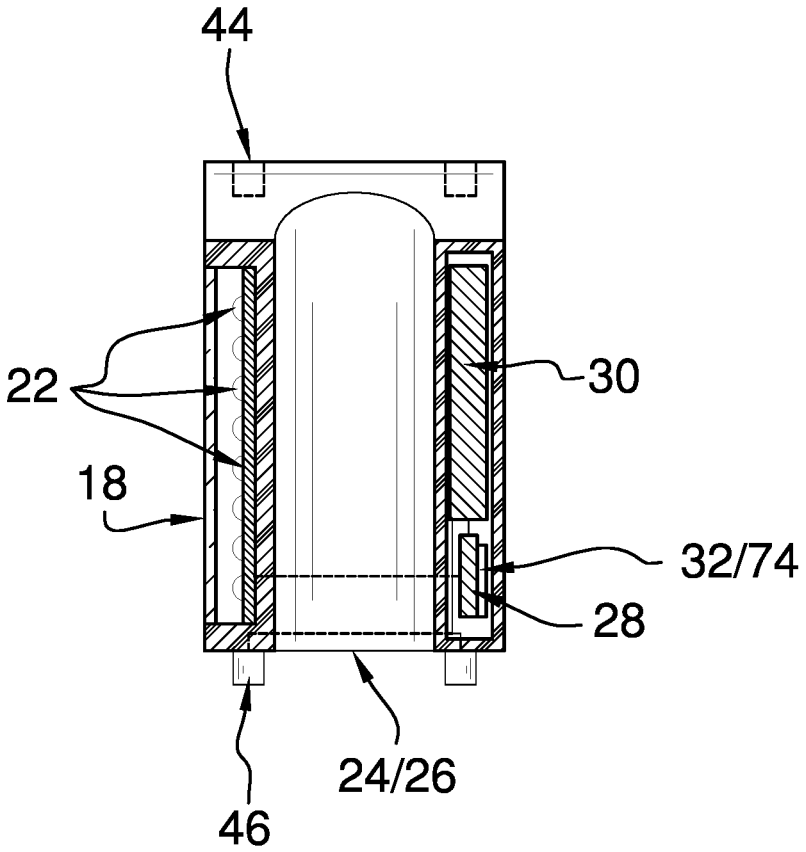
FIG. 5 is a cross-sectional view of an embodiment of the disclosure.
Figure 6:
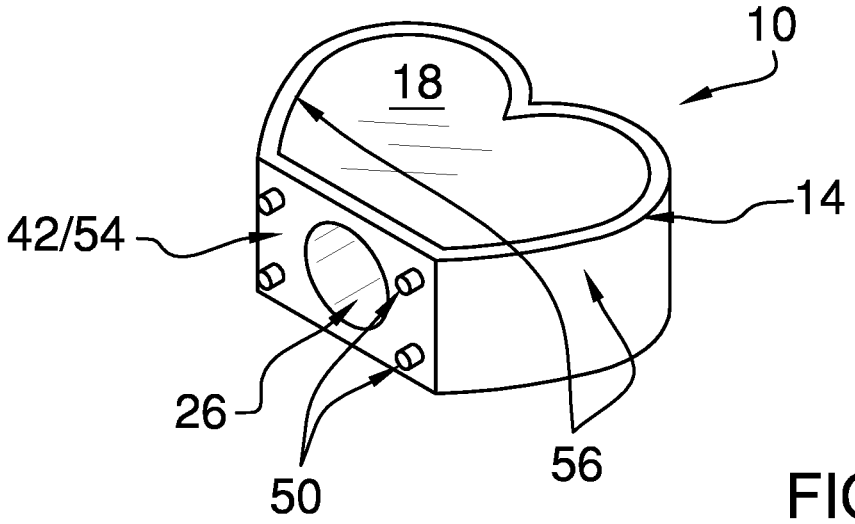
FIG. 6 is an isometric perspective view of an embodiment of the disclosure.

Programming code 34 is selectively positionable on an electronic device 36 of a user, such as a cellphone 38, as shown in FIG. 4. The programming code 34 enables the electronic device 36 to signal the microprocessor 28, via the first transceiver 32, to selectively actuate the bulbs 20. The programming code 34 may enable selective illumination of respective light emitting diodes 22 to display one or more of letters, text, shapes, symbols, and images. The programming code 34 also may enable selective illumination of respective light emitting diodes 22 to illuminate the shells 14 in a sequence or pattern.

Each shell 14 has a first facet 40 and a second facet 42. A first connector 44 and a second connector 46 are engaged to the first facet 40 and to the second facet 42, respectively. The second connector 46 is complementary to the first connector 44 so that the second connector 46 of one of the shells 14 is positioned to selectively engage the first connector 44 of another of the shells 14 to engage the shells 14 mutually and operationally. The first connector 44 comprises a set of first ports 48 and the second connector 46 comprises a set of plugs 50. The set of first ports 48 and the set of plugs 50 may comprise four first ports 48 and four plugs 50, respectively, as shown in FIG. 1.

Figure 2:
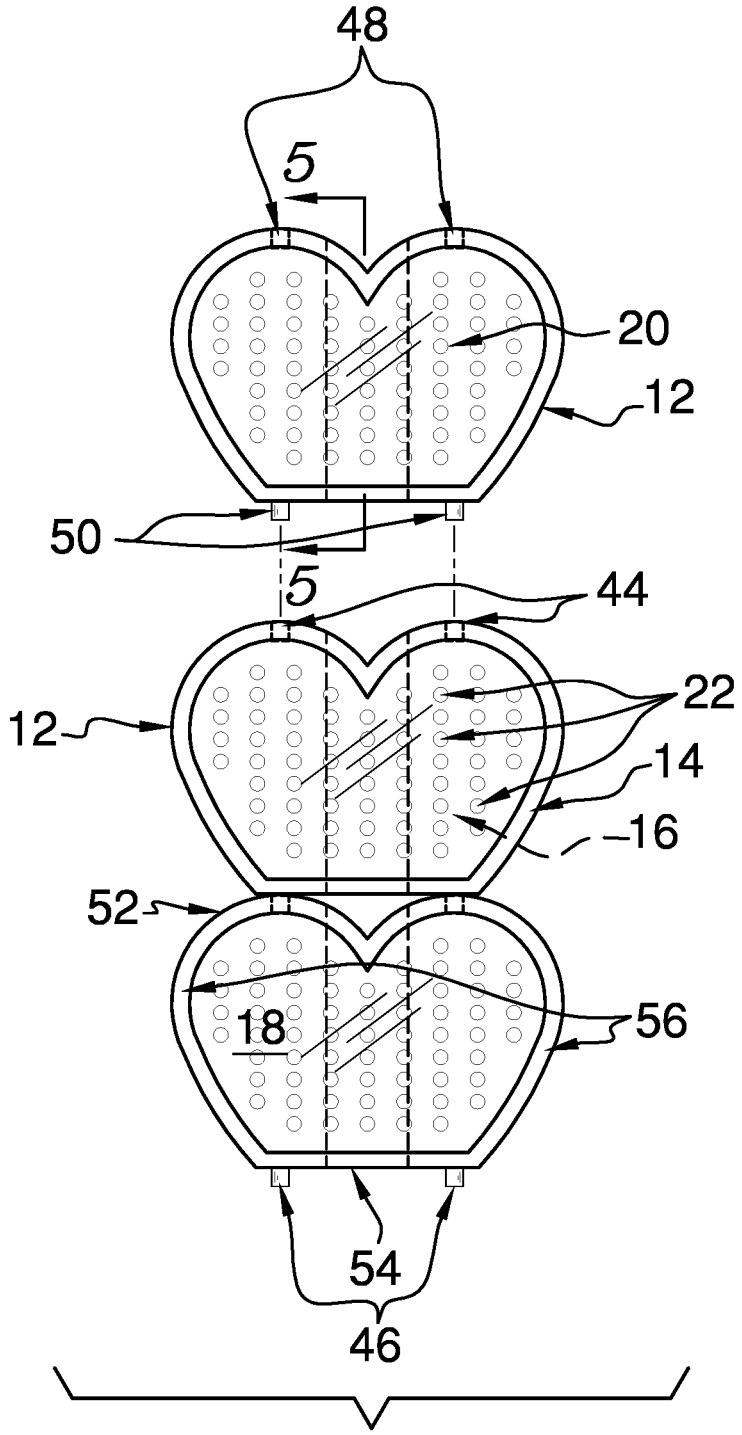
FIG. 2 is a front view of an embodiment of the disclosure.
Figure 3:
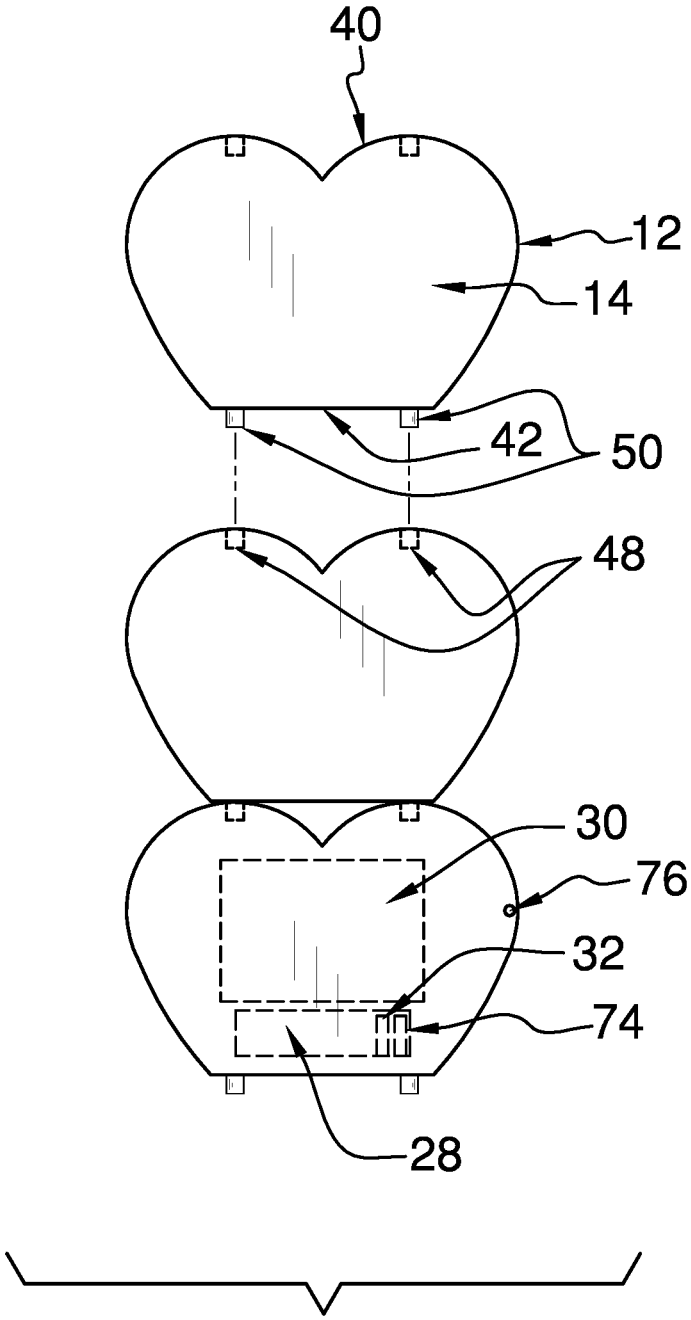
FIG. 3 is a back view of an embodiment of the disclosure.

As shown in FIGS. 2 and 4, the first ports 48 and the plugs 50 are positioned on a top 52 and a bottom 54 of a shell 14, respectively. Though the shell 14 in this example is substantially heart shaped, the present invention anticipates shells 14 having a variety of shapes, such as, but not limited to, cuboid, spherical, and the like. The positioning of the first ports 48 and the plugs 50 in this example allows for attachment of multiple shells 14 along a single lock of hair. The present invention also anticipates the first ports 48 and the plugs 50 being positioned on opposed sides 56 of the shell 14, allowing for attachment of the shells 14 to adjacently positioned locks of hair.

The illuminable hair attachment assembly 10 also may comprise a charging station 58. The charging station 58 comprises a power cord 60, which is engaged to and extends from a housing 62. The power cord 60 is configured to be operationally engaged a source of electrical current. A plurality of third connectors 64 is engaged to an upper face 66 of the housing 62 and is operationally engaged to the power cord 60. The third connectors 64 are complementary to the second connectors 46 so that the second connector 46 of a respective hair attachment 12 is positioned to selectively engage a respective third connector 64 to operationally engage the battery 30 of the respective hair attachment 12 to the power cord 60 to charge the battery 30. Each third connector 64 may comprise a second port 68, as shown in FIG. 1.

A switch 70 is engaged to the housing 62 and is operationally engaged to the power cord 60 and the plurality of third connectors 64. The switch 70 is positioned to selectively engage the power cord 60 to the plurality of third connectors 64. An indicator 72 is engaged to the housing 62 and is operationally engaged to the switch 70. The indicator 72 is positioned to indicate a status of the switch 70. For example, the indicator 72 may illuminate green for "ON" and red for "OFF".

The present invention also anticipates at least one of the hair attachments 12 comprising a second transceiver 74, which is global positioning system enabled. The second transceiver 74 enables coordinates of a location of a user wearing the hair attachment 12 to be determinable and transmittable. For example, a parent or guardian of a child wearing the hair attachment 12 would be able to access a location of the child.

The present invention also anticipates at least one of the hair attachments 12 comprising a microphone 76, which is configured to capture an audio signal proximate to the user wearing the hair attachment 12. The microphone 76 is operationally engaged to the microprocessor 28, positioning the microprocessor 28 to transmit the audio signal, via the first transceiver 32, to the electronic device 36 of the user.

In use, respective shells 14 are engaged to a lock of hair by sequentially inserting the lock of hair through the tubes 26 positioned through the shells 14. The shells 14 then are mutually engaged by inserting the plugs 50 into the first ports 48. The programming code 34 on the cellphone 38 enables the user to selectively actuate the bulbs 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminable hair attachment assembly comprising:

a hair attachment comprising:

a shell defining an interior space, at least one face of the shell being substantially transparent, a bulb engaged to the shell and positioned in the interior space, and a fastener engaged to the shell and being configured for engaging a lock of hair for removably engaging the shell to the lock of hair;

the hair attachment being one of a plurality of hair attachments, at least one of the hair attachments having a microprocessor, a battery, and a first transceiver engaged to the shell and positioned in the interior space, the microprocessor being operationally engaged to the battery and the first transceiver, the shells being selectively mutually couplable, such that all the bulbs of mutually coupled hair attachments are operationally engaged to the microprocessor; and programming code selectively positionable on an electronic device of a user enabling the electronic device for signaling the microprocessor, via the first transceiver, for selectively actuating the bulbs.

2. The illuminable hair attachment assembly of claim 1, wherein the bulb comprises a plurality of light emitting diodes.

3. The illuminable hair attachment assembly of claim 2, wherein the programming code enables selective illumination of respective light emitting diodes for one or more of:

displaying one or more of letters, text, shapes, symbols, and images; and illuminating the shells in a sequence or pattern.

4. The illuminable hair attachment assembly of claim 1, wherein the fastener comprises a tube passing through the shell and being isolated from the interior space, wherein the tube is configured for insertion of a lock of hair for removably engaging the shell to the lock of hair.

5. The illuminable hair attachment assembly of claim 1, further including:

each shell having a first facet and a second facet;

a first connector engaged to the first facet; and a second connector engaged to the second facet, the second connector being complementary to the first connector, such that the second connector of one of the shells is positioned for selectively engaging the first connector of another of the shells for mutually and operationally engaging the shells.

6. The illuminable hair attachment assembly of claim 5, wherein:

the first connector comprises a set of first ports; and the second connector comprises a set of plugs.

7. The illuminable hair attachment assembly of claim 6, wherein:

the set of first ports comprises four first ports; and the set of plugs comprises four plugs.

8. The illuminable hair attachment assembly of claim 5, further including a charging station comprising:

a housing;

a power cord engaged to and extending from the housing, the power cord being configured for operationally engaging a source of electrical current; and a plurality of third connectors engaged to an upper face of the housing and being operationally engaged to the power cord, the third connectors being complementary to the second connectors, such that the second connector of a respective hair attachment is positioned for selectively engaging a respective third connector for operationally engaging the battery of the respective hair attachment to the power cord for charging the battery.

9. The illuminable hair attachment assembly of claim 8, wherein:

the first connector comprises a set of first ports;

the second connector comprises a set of plugs; and each third connector comprises a second port.

10. The illuminable hair attachment assembly of claim 8, further including a switch engaged to the housing and being operationally engaged to the power cord and the plurality of third connectors, such that the switch is positioned for selectively engaging the power cord to the plurality of third connectors.

11. The illuminable hair attachment assembly of claim 10, further including an indicator engaged to the housing and being operationally engaged to the switch, such that the indicator is positioned for indicating a status of the switch.

12. The illuminable hair attachment assembly of claim 1, further including at least one of the hair attachments comprising a second transceiver, the second transceiver being global positioning system enabled, such that coordinates of a location of a user wearing the hair attachment are determinable and transmittable.

13. The illuminable hair attachment assembly of claim 1, further including at least one of the hair attachments comprising a microphone configured for capturing an audio signal proximate to the user wearing the hair attachment, the microphone being operationally engaged to the microprocessor, such that the microprocessor is positioned for transmitting the audio signal, via the first transceiver, to the electronic device of the user.

14. An illuminable hair attachment system comprising:

a hair attachment comprising:

a shell defining an interior space, at least one face of the shell being substantially transparent, a bulb engaged to the shell and positioned in the interior space, and a fastener engaged to the shell and being configured for engaging a lock of hair for removably engaging the shell to the lock of hair;

the hair attachment being one of a plurality of hair attachments, at least one of the hair attachments having a microprocessor, a battery, and a first transceiver engaged to the shell and positioned in the interior space, the microprocessor being operationally engaged to the battery and the first transceiver, the shells being selectively mutually couplable, such that all the bulbs of mutually coupled hair attachments are operationally engaged to the microprocessor;

an electronic device; and programming code positioned on the electronic device enabling the electronic device for signaling the microprocessor, via the first transceiver, for selectively actuating the bulbs.

15. An illuminable hair attachment assembly comprising:

a hair attachment comprising:

a shell defining an interior space, at least one face of the shell being substantially transparent, a bulb engaged to the shell and positioned in the interior space, the bulb comprising a plurality of light emitting diodes, and a fastener engaged to the shell and being configured for engaging a lock of hair for removably engaging the shell to the lock of hair, the fastener comprising a tube passing through the shell and being isolated from the interior space, wherein the tube is configured for insertion of a lock of hair for removably engaging the shell to the lock of hair;

the hair attachment being one of a plurality of hair attachments, at least one of the hair attachments having a microprocessor, a battery, and a first transceiver engaged to the shell and positioned in the interior space, the microprocessor being operationally engaged to the battery and the first transceiver, the shells being selectively mutually couplable, such that all the bulbs of mutually coupled hair attachments are operationally engaged to the microprocessor;

programming code selectively positionable on an electronic device of a user enabling the electronic device for signaling the microprocessor, via the first transceiver, for selectively actuating the bulbs, the programming code enabling selective illumination of respective light emitting diodes for one or more of:

displaying one or more of letters, text, shapes, symbols, and images, and illuminating the shells in a sequence or pattern;

each shell having a first facet and a second facet, a first connector being engaged to the first facet, a second connector being engaged to the second facet, the second connector being complementary to the first connector, such that the second connector of one of the shells is positioned for selectively engaging the first connector of another of the shells for mutually and operationally engaging the shells, the first connector comprising a set of first ports and the second connector comprising a set of plugs, the set of first ports comprising four first ports, the set of plugs comprising four plugs;

a charging station comprising:

a housing, a power cord engaged to and extending from the housing, the power cord being configured for operationally engaging a source of electrical current, a plurality of third connectors engaged to an upper face of the housing and being operationally engaged to the power cord, the third connectors being complementary to the second connectors, such that the second connector of a respective hair attachment is positioned for selectively engaging a respective third connector for operationally engaging the battery of the respective hair attachment to the power cord for charging the battery, each third connector comprising a second port;

a switch engaged to the housing and being operationally engaged to the power cord and the plurality of third connectors, such that the switch is positioned for selectively engaging the power cord to the plurality of third connectors, and an indicator engaged to the housing and being operationally engaged to the switch, such that the indicator is positioned for indicating a status of the switch;

at least one of the hair attachments comprising a second transceiver, the second transceiver being global positioning system enabled, such that coordinates of a location of a user wearing the hair attachment are determinable and transmittable; and at least one of the hair attachments comprising a microphone configured for capturing an audio signal proximate to the user wearing the hair attachment, the microphone being operationally engaged to the microprocessor, such that the microprocessor is positioned for transmitting the audio signal, via the first transceiver, to the electronic device of the user.

* * * * *